United States Patent [19]

Rysewyk

[11] 4,239,443

[45] Dec. 16, 1980

[54] MOBILE HOIST

[75] Inventor: Ambrose L. Rysewyk, Elgin, Ill.

[73] Assignee: Western Electric Company, Incorporated, New York, N.Y.

[21] Appl. No.: 16,058

[22] Filed: Feb. 28, 1979

[51] Int. Cl.[3] ..... B66C 19/00

[52] U.S. Cl. ..... 414/618; 414/663; 212/208; 212/142.1

[58] Field of Search ..... 414/266-286, 414/660-664, 666-672, 618, 621, 626, 460-461, 426, 589; 212/140-141, 145, 135, 208, 142.1, 142; 187/9; 294/16

[56] References Cited

U.S. PATENT DOCUMENTS

| | | | |
|---|---|---|---|
| 3,181,707 | 5/1965 | Janssen | 212/145 |
| 3,433,459 | 3/1969 | Logan | 414/626 |
| 3,827,742 | 8/1974 | Holden | 294/16 |
| 3,858,736 | 1/1975 | French, Jr. et al. | 414/633 |

FOREIGN PATENT DOCUMENTS

| | | | |
|---|---|---|---|
| 26622 | 5/1931 | Australia | 212/140 |

OTHER PUBLICATIONS

Western Electric Internal Instruction Memorandum "U1S-17H", p. 3.

*Primary Examiner*—Stephen G. Kunin
*Assistant Examiner*—Lawrence E. Williams
*Attorney, Agent, or Firm*—R. P. Miller

[57] ABSTRACT

A stable hoist for loading and unloading articles (10) onto and from shelves (11) includes a base housing (12) from which extends a cruciform-shaped standard (13). A slide arrangement (14) mounted on the standard and driven by a power source (46 and 47) mounted in the housing moves a boom (16) up and down. The boom comprises a slide (20) and a trolley (21) from which depends a clamp (22) to grip the article. Inverted L-shaped arm structures (28 and 29) extend from the crossarms (26 and 27) of the cruciform-shaped standard (13). Stabilizing plates (48 and 49) are pivotally mounted in arm sections (33 and 34) to engage the shelf during a loading or unloading operation. The weight of components mounted in the base housing (12) and on the cruciform-shaped standard (13) act to counterbalance the tilting force during a loading and unloading operation.

18 Claims, 7 Drawing Figures

FIG. 7
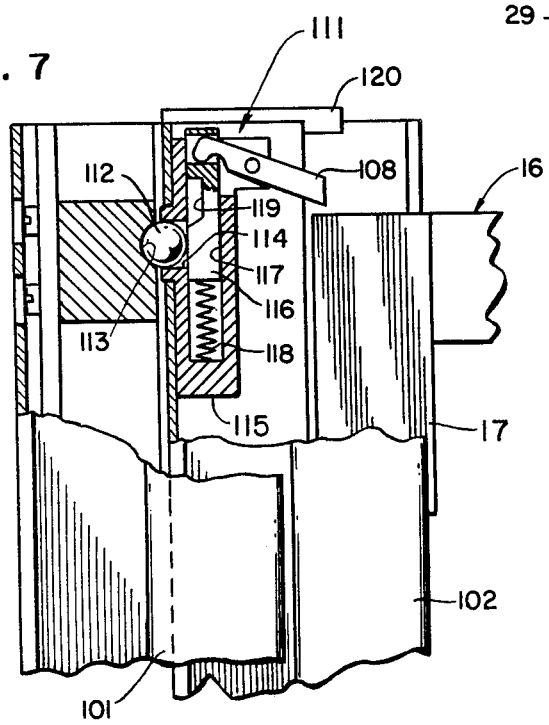
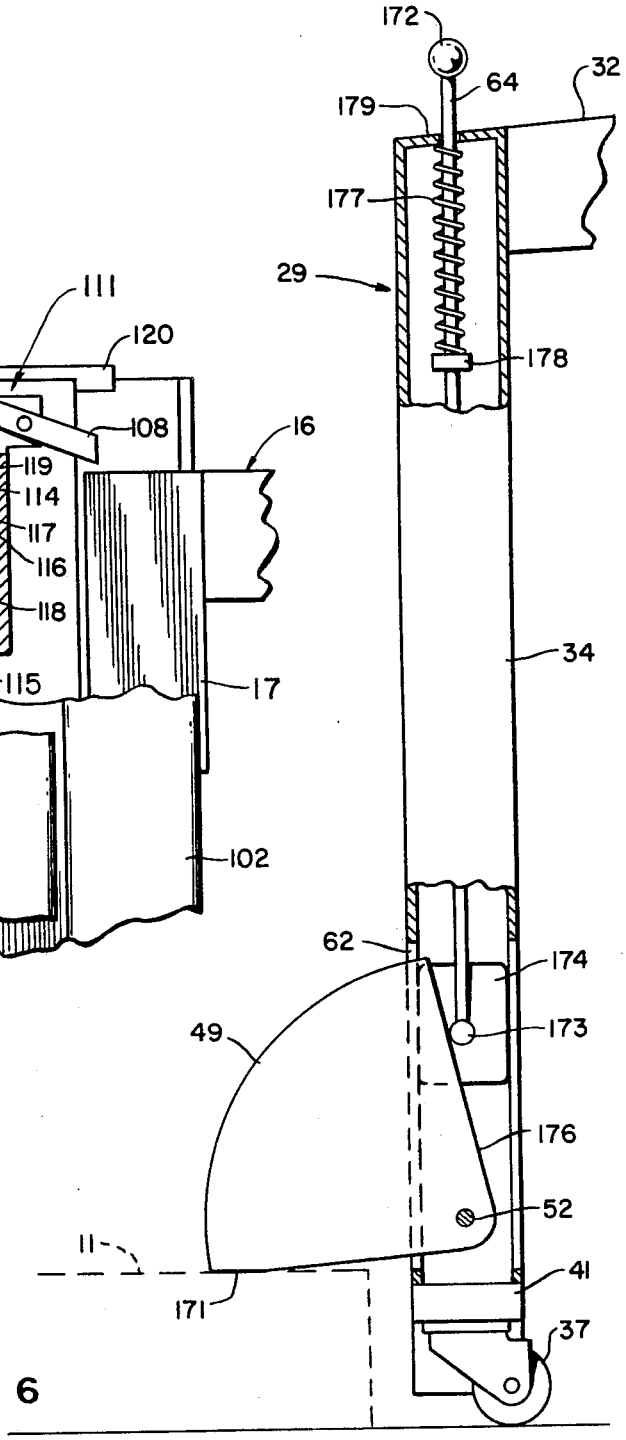
FIG. 6

MOBILE HOIST

TECHNICAL FIELD

This invention relates to mobile hoists and more particularly, to a hoise for lifting articles within a frame structure and then moving the articles from within the frame structure onto a shelf.

BACKGROUND OF THE INVENTION

In warehousing of heavy articles, there is a continuous need for mobile, lightweight hoist vehicles for placing and removing articles to and from multi-tiered shelves. In the construction of such hoists, consideration must be given to providing a hoist that can be moved along relatively narrow aisles without interferences with overhaging wiring, plumbing and duct work. There are also needs for such hoists to load and unload heavy battery cells on shelves for use as emergency power supplies for telephone exchanges or as energy sources for computer installations.

Numerous diverse types of lift trucks, mobile hoists and gantry arrangements have been developed to facilitate the placing and removal of heavy objects onto and from multi-tiered shelving. One example of a hoist that has been developed to move round cell batteries onto and from multi-tiered shelving is shown in R. C. French et al. U.S. Pat. No. 3,858,736 issued Jan. 7, 1975. In this patent a castered flat platform supports a rotatably mounted pole from which laterally extends a slide and tong-like clamp assembly. The clamp assembly is movably mounted on the pole so that an article can be lifted and orbited about the pole and then moved over and onto a shelf. Laterally extending foldable, stabilizing arms are provided to counteract forces tending to tilt the hoist during loading and unloading operations.

SUMMARY OF THE INVENTION

This invention contemplates, among other things, a mobile hoist having an open frame structure for receiving an article which is clamped, lifted and moved from within the frame structure onto a shelf.

More particularly, an elongated housing supports a cruciform having inverted L-shaped legs extending from the crossarms of the cruciform to form an open, structural framework which can be moved over an article to be lifted. The upright section of the cruciform supports a multi-slide device from which extends a boom comprising a tubular slide encasing a trolley. Depending from the trolley is a clamp for engaging an article positioned within the open structural framework. A motor and winch mounted in the elongated housing actuates the multi-slide device to lift a clamped article, which can then be moved over and onto a shelf. The weight of the motor and winch act to counteract tilting forces imparted to the hoist when the boom elements are extended to load an article onto the shelf. The downwardly extending portions of the inverted L-shaped legs are slotted to receive quadrant-shaped outrigger plates which are selectively locked in engagement with a shelf surface to impart added rigidity to the hoist during movement of an article onto a shelf.

With the afore-described particular design of the open frame structure, the hoist is relatively light and, thus, can easily be moved along the aisles and positioned alongside of shelving. The structural arrangement of the frame and outriggers provide a stable structure which permits loading and unloading of heavy articles without introducing forces that may stress the structural elements and tilt the hoist. Further, the particular structural arrangement provides a hoist that has a relatively low and narrow profile to permit movement along narrow aisles without interfering with overhanging or projecting pipes, conduits, wires or other fixtures.

BRIEF DESCRIPTION OF THE DRAWING

Other features and advantages of the present invention will be apparent upon consideration of the following detailed specification and the drawing, wherein

FIG. 6 is a sectional view of one of a set of legs for supporting the hoist which particularly shows a self adjusting outrigger device for stabilizing the hoist during lifting and movement of a clamped article onto a shelf; and FIG. 7 is a partial, sectional view showing the details of construction of the sequence lock for controlling the extension of the slide mechanism.

DETAILED DESCRIPTION

Figure 1:
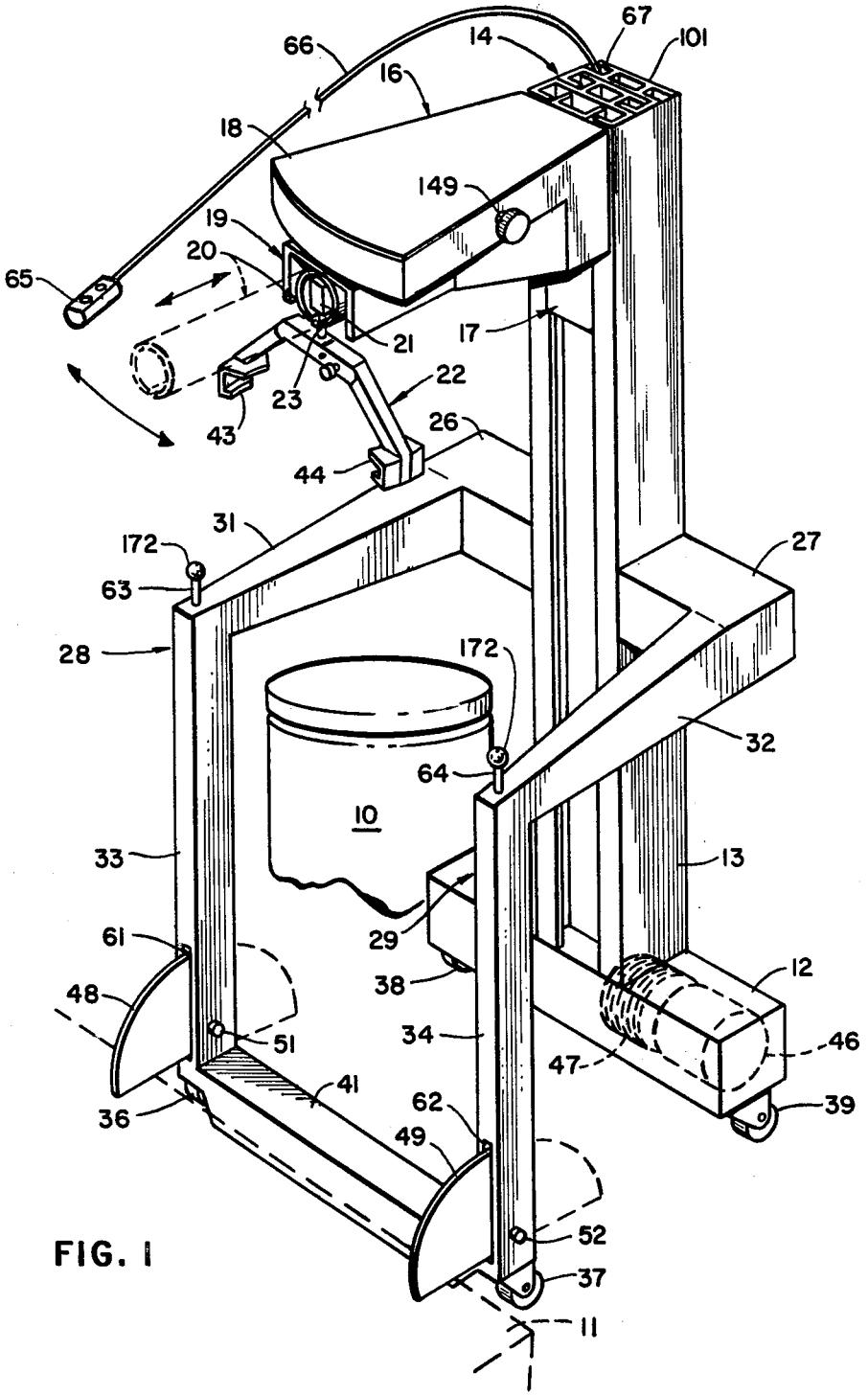
FIG. 1 is a perspective view of a mobile hoist embodying the principles of the present invention.

Referring to FIG. 1, there is shown a mobile hoist embodying the features of the present invention, and which is particularly adapted to lifting the loading articles such as a round cell battery cell 10 onto a shelf 11 of a multi-tiered shelving installation. Round battery cells are rather heavy, weighing approximately 350 lbs. Multi-tiered banks of batteries of this type are used extensively as emergency or auxiliary energy supplies in telephone switching exchanges. These batteries are also widely used as primary energy sources for computer installations.

In general, the hoist comprises a rectangular-shaped, elongated housing 12 on which is mounted a vertically extending standard 13 that provides a mounting for a multi-slide arrangement 14. A boom 16 is secured to an inner elevating slide 17 of the multi-slide arrangement. The boom 16 comprises a first housing 18 for supporting a channel-shaped track 19 and a tubular shaped channel slide 20 in which is movably mounted a trolley 21 attached to a clamp 22 through the agency of a short chain 23.

The standard 13 is secured to a pair of horizontally extending crossarms 26 and 27. These arms are secured at an approximate mid-height position to the standard 13 so as to form with the standard a structure in the shape of a cruciform. Attached to the ends of the crossarms 26 and 27 are a pair of inverted L-shaped arms 28 and 29. The L-shaped arms 28 and 29 comprise horizontal arm sections 31 and 32 which are substantially parallel to each other, and downwardly extending arm sections 33 and 34 which are also substantially parallel to each other. The arm sections 33 and 34 are constructed of rectangular tubular stock and terminate in proximity to a plane which runs through the flat bottom of the housing 12. A set of four casters 36, 37, 38 and 39 are mounted on the ends of the legs 33 and 34 and on the opposed extremities of the bottom of the elongated housing 12. The ends of the legs 33 and 34 are interconnected by a brace 41 which functions to add stability to the open framework of the hoist.

It will be noted that there is an archway space between the standard 13 and the downward extending leg sections 33 and 34 which permits an operator to wheel the hoist over a battery 10. In the alternative, this space is sufficiently wide to permit a lift truck to move a battery into the space. With a battery positioned in the space, the clamp 22, which is connected by the chain 23 to the trolley 21, is positioned so that cleats 43 and 44 grip the top of the battery 10. With the battery gripped, a motor drive 46 and winch 47, mounted within the housing 12, are operated to extend the slides 14 and elevate the battery. The hoise structure may then be moved adjacent to the shelf 11.

With the hoist in position to place the battery on the shelf, the brace 41 will abut the edge of the shelf and a pair of outrigger quadrant plates 48 and 49 are moved to engage the top surface of the shelf. The plates 48 and 49 are mounted on pivot pins 51 and 52 extending through slots 61 and 62 formed in the lower extremities of the leg sections 33 and 34. Release and lock rods 63 and 64 extend through the legs 33 and 34 and self adjust to lock the outrigger plates 48 and 49 in position to engage the top surface of the shelf 11 and, hence, add stability to the hoist during the movement of a battery over and onto the shelf. To move an elevated and gripped battery, the attending operator will merely grasp and pull the elevated clamp to move the tubular slide 20 and trolley 21 over the shelf, whereafter the motor drive 46 and winch 47 are operated by depressing a down button on a switch 65. The switch 65 also includes an up button and is connected by a flexible cable extending through a passage 67 in the slide mechanism mounted to a circuit for operating the motor drive 46. The battery 10 is lowered and deposited on the shelf and the clamp is released by the operator in anticipation of the next battery shelving operation.

While the battery is suspended over the shelf, forces tending to tilt the hoist are counteracted by (1) the locked outrigger plates 48 and 49 and (2) the weight of the slide arrangement 14, the housing 12, the motor drive 46 and the winch 47. With this structural arrangement, a stable hoist is provided that is rather narrow to facilitate movement along narrow aisles, while presenting a low profile which permits movement along an aisle without interference with overhanging pipes, wires or duct work.

The motor 46 and the winch 47 are substantially conventional devices and may be interconnected with a gear reduction mechanism. The basic multi-slide arrangement 14 is of commercial manufacture and may be obtained by Genie Industries, Kirkland, Washington. Despite the number of component parts in the hoist structure, the overall weight is relatively small. A hoist of the described type has been constructed that weighs less than 300 lbs. and which is capable of shelving round cell batteries weighing 350 lbs.

Figure 2:
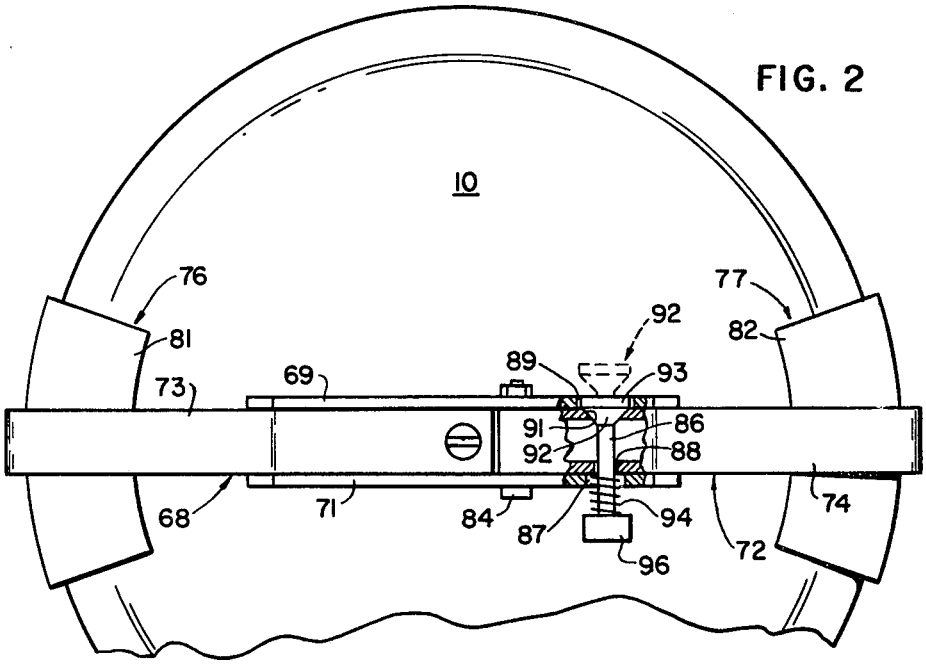
FIG. 2 is a top view partially in section of a quick action clamp for gripping an article such as a round cell battery.
Figure 3:
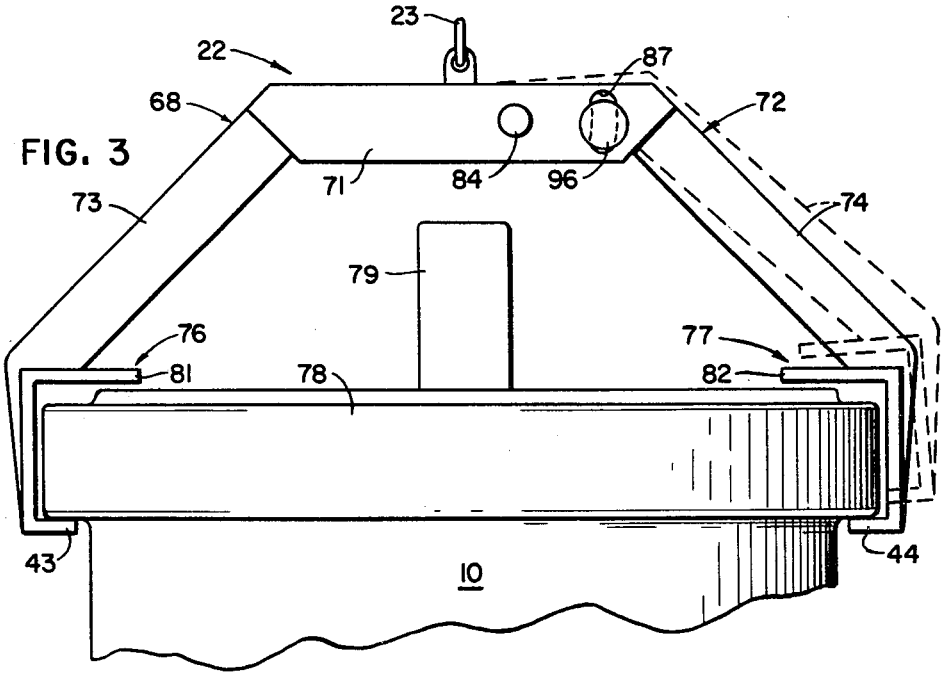
FIG. 3 is a side view of the clamp shown in FIG. 2.

Considering now the details of construction of several of the more salient components, attention is directed to FIGS. 1, 2 and 3 for a consideration of the clamp 22. The clamp includes an arm 68 having bifurcations 69 and 71 extending over an arm 72. The arms 68 and 72 have angularly extending sections 73 and 74 which are welded to article lifting members 76 and 77 for gripping a peripherally overhaning cover 78 of a round battery cell 10. The lifting members 76 and 77 include the cleats 43 and 44 and are provided with stops 81 and 82 which rest on the top of the cover 78 to prevent the clamp 22 from shorting out battery terminal 79, and to insure that the cleats are laterally aligned with the peripheral extending portion of the battery cover 78.

The bifurcations extending from arm 68 are pivotally connected to the arm 72 by a pivot pin 84. A lock pin 86 extends through the arcuate slot 87 formed in the bifurcation 71. A bore 88 is formed in arm 72 and a circular slot 89 is formed in bifurcation 69. Bore 88 is enlarged to provide a conical seat 91 to receive a conical-shaped enlargement 92 formed on the end of the pin 86. The enlargement 92 is provided with a straight peripheral lip 93. A coiled spring 94 extends through arcuate slot 87 and is interposed between arm 72 and a head 96 of the lock pin 86. By depressing the lock pin head 96, the conical enlargement 92 is moved out of the seat 89, thus permitting the operator to move arm section 74 relative to arm section 73 through a limited arc as determined by the length of the arcuate slot 87.

In use of the clamp, the operator will depress lock pin 86 to free arms 68 and 72, thus permitting the operator to spread the arm sections 73 and 74 and thereby allowing the clamp to be moved so as to position the lifting members 76 and 77 about the cover 78 of the battery cell. At this time, the rest stops 81 and 82 will engage the upper surface of the battery cover 78 to prevent clamp 22 from shorting out cell terminal 79 and to insure that the cleats 43 and 44 are positioned to engage the overhanging portion of the cover 78.

the lock pin 86 is released and the hoist motor is energized to raise the boom 16 and, hence, the clamp. Due to gravity, the arm sections 73 and 74 will pivot about pivot pin 84 to move the cleats 43 and 44 inwardly toward each other to grip the cover 78 of the battery 10. At this time the spring 94 acting on the head 96 forcibly moves the lock pin 86 to seat the conical enlargement 92 in the conical slot 91. The peripheral lip 93 of pin 86 is now fitted within the circular slot 89 to lock the arm 68 to the arm 72. With the clamp in the locked position, the round cell battery 10 may be lifted and moved onto or off from a shelf 11.

Figure 4:
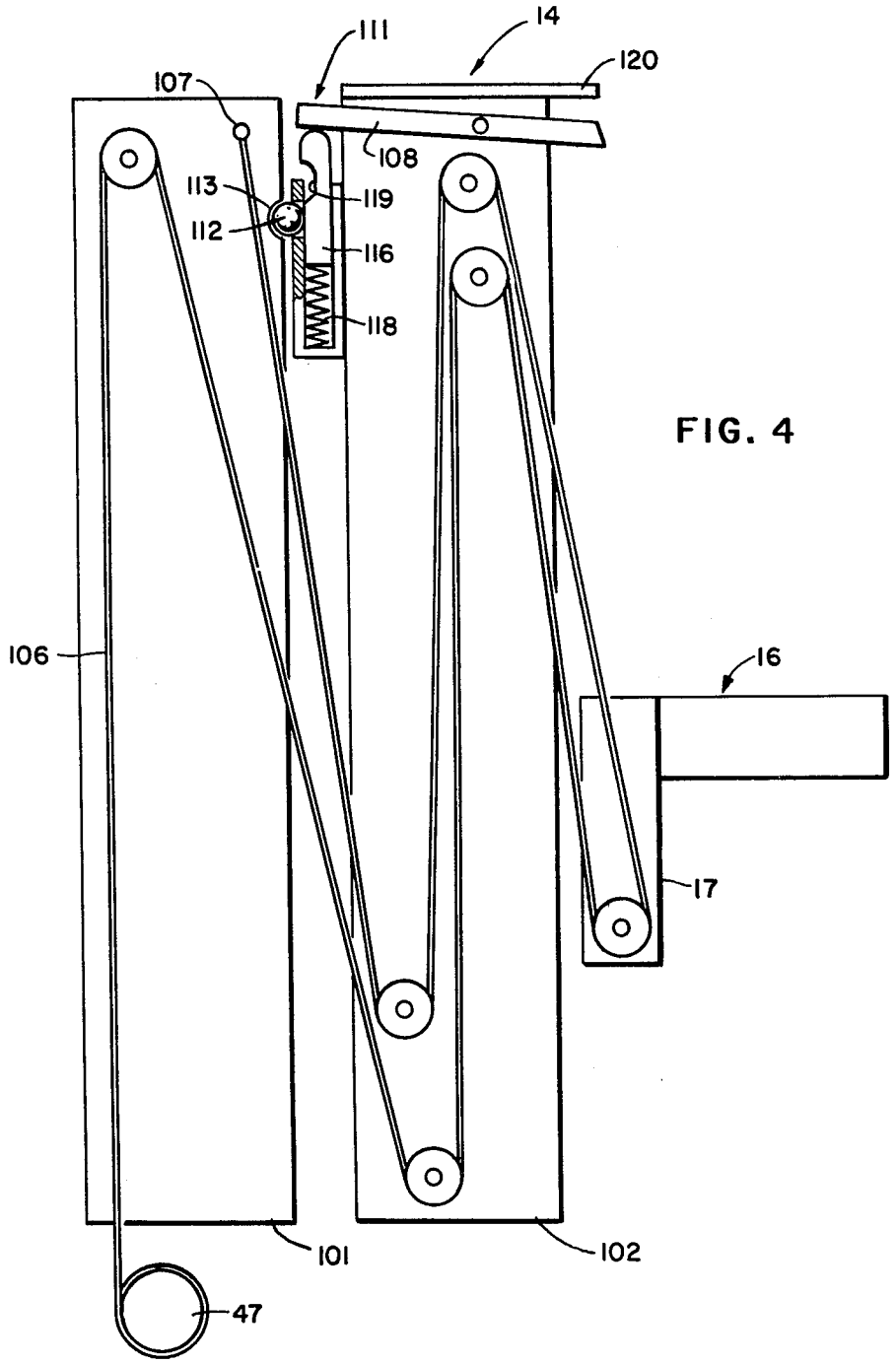
FIG. 4 is a schematic view of a slide mechanism and a sequence lock for elevating the clamp.

Attention is directed to FIG. 4 for a brief consideration of the kinematics of the elevating slide mechanism 14. The mechanism includes a fixed slide guide 101 forming part of the standard 13, a first movable slide 102 mounted on guide 101 and the second movable boom slide 17 mounted on slide 102. The drum of the winch 47 has anchored thereto a cable 106 which extends around the illustrated pulleys which are rotatably mounted on the guide 101 and the slides 102 and 17. This cable is anchored at 107 to the fixed slide guide 101. Upon operation of the winch 47, the cable will be wound on the drum of the winch and, initially, the slide 17 will move upwardly relative to the slide 102 until it strikes a release bar 108. The bar, the pulley and cable arrangement, and an unique sequence lock 111 are not furnished as part of the commercial slide arrangement 14.

Normally the slide 102 is held from movement by the unique sequence lock 111 which locks the slide 102 to the stationary slide guide 101. As best shown in FIG. 7, the sequence lock includes a ball 112 having a portion thereof resting in a circular recess 113 formed in a stationary portion of the fixed guide 101. A portion of the ball 112 extends into a bore 114 formed in a block 115 attached to the movable slide 102, and thereby locks the slide 102 to the fixed slide guide 101. The extending portion of the ball 112 bears against a plunger 116 mounted in a second bore 117 running transversely through the block 115. The plunger 116 is urged by a spring 118 against the release bar 108. It will be noted that the plunger 116 is constructed to provide a release notch 119 for accommodating the ball 112 when the plunger is in a depressed position.

Returning now to a further consideration of the operation of the slide arrangement and referring to FIGS. 4 and 7, the slide 17 moves upwardly to strike and pivot the release bar 108. As the bar 108 pivots, the plunger 116 is depressed to move the notch 119 into register with the ball 112. Immediately thereafter, the slide 17 engages a stop 120 fixed to the slide 102, whereupon further forces applied to the slides, due to the winding of the cable 106, cam the ball 112 from the partial recesses 113 into the now aligned notch 119 thereby releasing the slide 102 from the fixed guide 101. The subsequent winding of additional cable is thereupon effective to now lift the slide 102 along with the slide 17.

Figure 5:
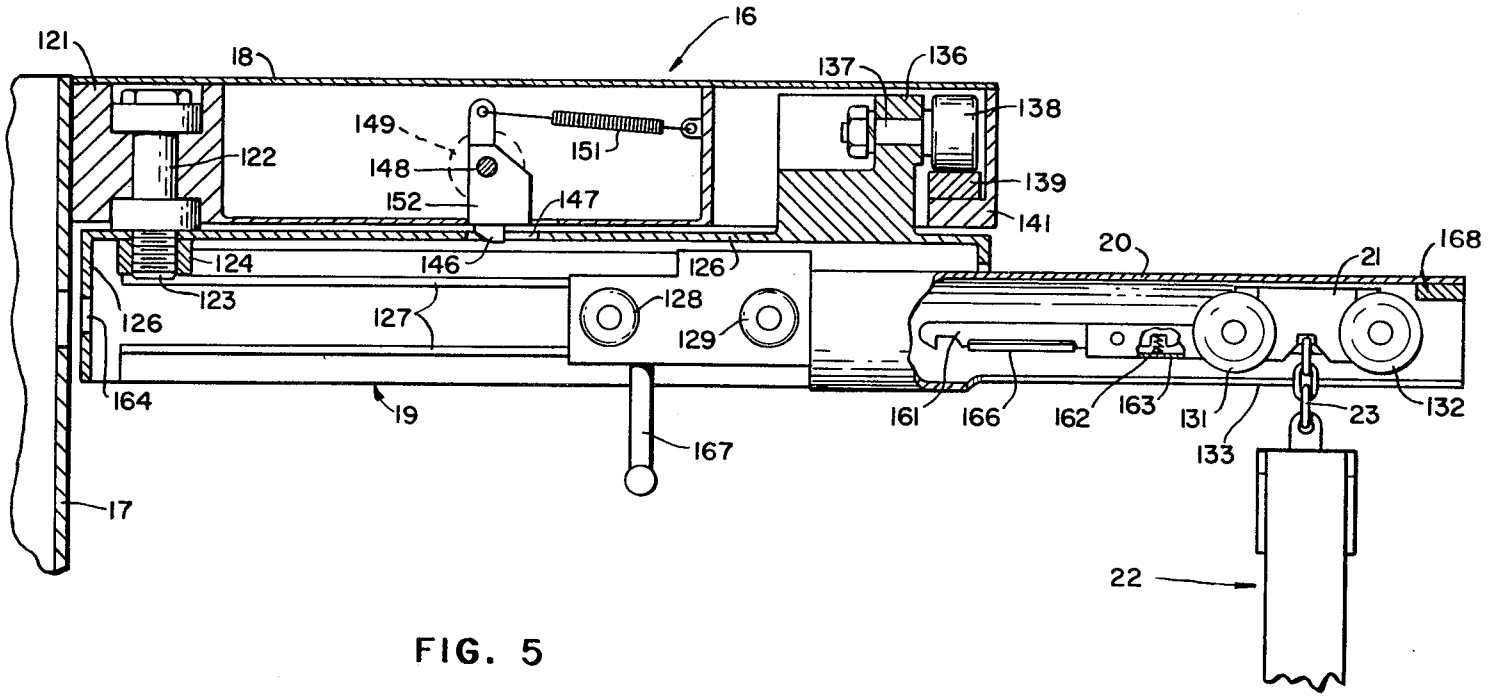
FIG. 5 is a side view partially in section of a boom slide and trolley arrangement pivotally attached to and extending from one of the slides of the elevating slide mechanism.

Turning now to a consideration of FIG. 5, there is shown a cross section of the details of the boom 16 which include the first housing 18 constructed of plate-like sheets of steel. This housing includes a block 121 which is secured to the slide 17. The block 121 is bored to receive a pivot pin 122 having a threaded section 123 seated in a threaded member 124 attached to a second steel plate housing 126 of the channel-shaped track generally designated by the reference numeral 19. This second housing, which is in the form of an inverted U, supports two sets of channel tracks 127 mounted on opposed horizontal side walls of the housing 126. The drawing only shows one set of the tracks 127. These tracks act as guides for two pairs of rollers 128 and 129 secured to a rear extension of the tubular slide 20. Tubular slide 20, in turn, supports a set of wheels 131 and 132 rotatably mounted on the trolley 21. The trolley 21 is attached to one end of the chain 23 which extends through an elongated slot 133 and is connected at its other end to the clamp 22.

Attached to the upper plate of the housing 126 is a recessed block 136 having a pin 137 passing therethrough to support a roller 138 that rides on an arcuate track bar 139 which, in turn, is secured to a depending L-shaped section 141 of the housing 18. This structural arrangement relieves cantilever forces that are imparted to the second housing 126 and the tubular slide 19 during a lifting of a battery by the clamp and the transport of the battery onto the shelf.

The housing 126 may be selectively locked in a number of positions relative to the housing 18. Recalling that the housing 126 is pivotally mounted by the pin 122 to the housing 18, there is provided a spring-biased latch 146 which may be selectively positioned in a number of radial slots 147, only one shown, formed in an arcuate array in the top surface of the housing 126. The latch 146 is secured to an actuator pin-like shaft 148 having a section extending beyond the housing on which is mounted a turning knob 149 (see FIG. 1). A spring 151 biases the latch against a stop plate 152 to hold the latch in the selected slot 147. An operator can turn the knob 149 to release the latch 146 to permit rotation of the housing 146 on pivot pin 122 into a selected angular position with respect to the housing 18. The housing may be locked in the selected position by the dropping of the latch 146 into another of the slots formed in the top of the housing 126. With this arrangement, a first battery may be lifted and moved angularly from the space between the legs 31 and 32 onto the shelf 11. The latch is then released and the housing 126 moved relative to the housing 118 and then the latch is reset in another slot 147 so that the next battery may be lifted from the space between the legs 31 and 32 and transferred therefrom onto the shelf 11 in a position adjacent to the first positioned battery.

It will be noted that the trolley 21 is provided with a pivotally mounted laterally extending catch 161 which is biased into the illustrated horizontal position by a spring 162 interposed between a trailing portion of the catch 161 and an extension 163 of the trolley 21. As shown in FIG. 5, the left-hand portion of the housing 126 is provided with a slot 164. When the slide 20 and the trolley 21 is moved to their extreme left-hand positions, the catch 161 rides through the slot 164 and is latched by the spring to the left-hand wall of the housing 126.

This catch insures that the slide 20 and the trolley 21 will not move when the hoist is in operation to lift a battery positioned between the L-shaped arms 28 and 29, or when the hoist is used to transport a battery from one floor location to another. When a clamped and elevated battery are in position to be loaded onto a shelf, the operator will reach under the housing 126 and press on a plate 166 to release the catch 161 so that the slide 20 and trolley 21 may be moved to position the battery over the shelf. A handle 167 attached to the tubular slide 20 depends from the inverted U-shaped housing 126 and may be used to move the slide 20 in and out. The outward movement of the trolley 21 is limited by a stop 168 welded to the inside of the tubular slide 20.

Attention is directed to FIG. 6 for a consideration of the facilities for locking the outrigger stabilizing plates 48 and 49 in position. As shown in FIG. 6, the plate 49, identical to plate 48, is in the approximate shape of a quadrant of a circle. The plate 49 has a flat surface 171 for bearing on the shelf 11. It will be noted that the release rod 64 is provided with an actuating knob 172 which the operator will grasp and lift to release the plate 49 and permit the operator to pivot and set the plate in a self-adjusted position bearing against the surface of the shelf 11. More particularly, the release rod is secured at its lower end to a transversely extending stud pin cam 173 which is guided by a flat plate 174 that rides along the inner walls of the rectangular tubular leg section 34. The stabilizng plate 49 is provided with a second flat surface 176 which is engaged by cam 173 to lock the plate in position. Actually, the arc between the flat surfaces 171 and 176 spans about 80° to present a wedge-like opening to the cam 173 when it is forced downwardly to lock the plate 49 against the top of the shelf 11.

Following the loading of a battery onto a shelf, the movable release rod 64 is again lifted against the action of a spring 177 interposed between a collar 178 and the upper inner surface 179 of the arm section 34. The cam 173 is withdrawn above the area of the plate 49 and the plate may be then pivoted in a clockwise direction. The rod 64 is now released so that the cam 173 locks the plate 49 in an inward position. The other rod 63 and quadrant outrigger plate 48 are similarly constructed and operated. This outrigger withdrawal feature further enables the narrow profile hoist to be moved along narrow aisles without interference with structures or articles positioned along or projecting into the aisle.

Briefly summarizing, the attending operator moves the hoist over a battery 10 and then depresses the down button on the switch 65, whereupon the slide 17 moves downwardly to position the clamp 22 with the cleats 43 and 44 adjacent the cover of the battery. The head 96 of the lock pin 86 is depressed to push the conical pin enlargement 92 from within the conical seat 91 (see FIG. 2). The released arm sections 73 and 74 are pivoted to spread and fit the cleats 43 and 44 about the cover 78 of the battery. The operator now depresses the up button of the switch 65 to actuate the motor 46 and the winch 47 to cause the slide 17 to move upwardly to an elevation which will permit movement of the battery onto a shelf. If the desired shelf elevation is relatively high, the motor is actuated to move the slide 17 a sufficient distance to trip the bar 108 and release the sequence lock 111, which functions to disengage the slide 102 from the stationary guide 101. The continued operation of the winch 47 winds further cable to move the slide 102 upwardly along with the slide 17 which is now engaging the stop 120 on the slide 102.

The hoist is now moved adjacent to a shelf 11 with the cross brace 41 abutting the edge of the shelf. Next, the attending operator lifts the release rods 63 and 64 freeing the plates 48 and 49 which are the manually pivoted to move the flat edges 171 into self-adjusting engagement with the top of the shelf. The rods 63 and 64 are released whereupon the effects of the springs 177 and gravity move the guide plates 174 and cam pins 173 downwardly to engage and lock the pin cams 173 against the flat surfaces 176 of the quadrant plates 48 and 49.

The attending operator presses the catch release plate 166 (see FIG. 5) to release the catch 161. The clamp 22 is grasped and moved over shelf 11. The application of a pulling force to the clamp 22 causes the trolley 21 to ride outwardly within the tubular slide 20. Inasmuch as the tubular slide 20 is mounted on the rollers 128 and 129, which ride in the trackways 127, the slide 20 is also moved outwardly. The battery 10 is positioned over the desired shelf location, and then the down button on the switch 65 is pressed to lower the slide arrangement 14 to deposit the battery on the shelf.

In conclusion, it should be noted that when the boom slide and trolley are extended over a shelf during an article loading or unloading operation, there are forces tending to tilt the hoist about the forward casters 36 and 37. However, these forces are counteracted by the locked stabilizing plates 48 and 49 and the weight of the components mounted in the base housing 12 and on the cruciform-shaped standard 13.

What is claimed is:

1. A hoist, which comprises:

an elongated housing;

a standard extending upwardly from said housing;

a plurality of interconnected elevating slides mounted on the standard for successive extension relative to each other;

a boom extending from one of said slides;

a pair of crossarms extending from opposite sides of said standard in directions which are substantially parallel to the housing and orthogonal with respect to said boom;

a pair of inverted parallel L-shaped arms each having a horizontally extending section connected to one end of one of said crossarms and a downwardly extending section, said L-shaped arms being spaced apart to define an article receiving space therebetween;

a clamp connected to and extending downwardly from the boom toward the article receiving space between the inverted L-shaped arms for gripping an article positioned within the space; and a means mounted within said housing for successively actuating the slides to lift an article gripped by said clamp.

2. A hoist as set forth in claim 1, wherein the housing has a horizontal bottom and the ends of the downwardly extending arms terminate substantially in the plane of the bottom of the housing.

3. A hoist as set forth in claim 2, wherein the casters are mounted on opposite ends of the bottom of said housing and on the ends of said legs.

4. A hoist as set forth in claim 1, wherein said boom includes:

a first housing;

a second housing mounted on the first housing;

a channel slide mounted in said second housing for movement beyond said first and second housings;

a trolley mounted for movement along said channel slide; and means for connecting said clamp to said trolley.

5. A hoist as set forth in claim 4, which includes:

means mounting said second housing on said first housing for pivotal movement in a horizontal plane.

6. A hoist as set forth in claim 5, which includes:

a latch pivotally mounted on said first housing and projecting toward said second housing; and wherein said first housing is provided with a plurality of slots for receiving said latch to lock the second housing in one of a number of selected horizontal positions.

7. A hoist as defined in claim 4, which includes:

means for selectively holding said channel slide against movement.

8. A hoist as defined in claim 4, wherein the boom and extended channel slide are of sufficient lengths to move a clamped article from within the space defined between the horizontally extending sections of said arms.

9. A hoist as set forth in claim 4, wherein said boom includes:

means for pivotally mounting said second housing on said first housing; and a roller and a track supporting the projecting end of said second housing on the end of said first housing.

10. A hoist as set forth in claim 4, which includes:

a catch movably secured to said trolley; and means for engaging the catch to hold said channel slide and trolley within said second housing.

11. A hoist as defined in claim 1, wherein said downwardly extending sections of said inverted L-shaped arms are provided with slots, and which includes:

a pair of plates pivotally mounted within said slots, each of said plates having a flat edge which is pivotal into a horizontal position.

12. A hoist as defined in claim 11, wherein said downwardly extending section of said inverted L-shaped arms are provided with channels running from said slots to the top of said leg sections, and which includes:

a pair of rods individually mounted in said channels; and a pair of cam lock members individually mounted on the ends of said rods for engaging and holding said plates with the flat edges in the horizontal position.

13. A hoist as set forth in claim 1, wherein said actuating means includes:

a winch mounted in said housing; and a cable and pulley arrangement connected to said slides and actuated by said winch for sequentially moving said slides.

14. A hoist, which comprises:

a housing;

a cruciform having a vertically extending member mounted on the housing and a horizontally extending cross member;

a slide mechanism mounted on the vertically extending member;

a pair of arms horizontally extending from the ends of the cross member of said cruciform;

a pair of legs depending from the ends of the horizontally extending arms;

a boom secured to the slide mechanism and projecting over the space between the horizotally extending arms;

a clamp device mounted on the end of said boom for engaging and holding an article positioned between the horizontally extending arms; and motor driven means for actuating the slide mechanism to move the boom and clamp to lift a clamped article upwardly in the space between the horizontally extending arms.

15. A hoist, which comprises:

a housing;

a standard extending upwardly from the housing;

a slide mechanism mounted on the standard and extending vertically from the housing with a top section of the slide mechanism adjacent the top of the standard;

a boom structure extending horizontally from the top section of the slide;

a pair of aligned crossarms extending horizontally from opposite sides of the standard to form with the standard a cruciform;

a pair of horizontal arms extending in the same directions from the ends of the crossarms;

a pair of legs depending from the ends of the horizontal arms;

means for moving the slide up and down to move the clamp up and down in alignment with the space between the horizontal arms;

a slide mounted in said boom structure for extension beyond said horizontal legs;

a trolley mounted on the slide for movement therealong;

a clamp having a pair of article engaging cleats; and means for securing the clamp to said trolley.

16. A hoist as set forth in claim 15, which includes:

a winch and cable mechanism mounted in the housing for actuating said slide mechanism; and a motor drive means mounted in said housing for operating said winch mechanism.

17. A mobile hoist, which comprises:

an elongated, horizontal housing;

a standard extending vertically from the top of said housing;

a series of slides mounted on the standard, each of which is nested on top of each other to slide sequentially relative to each other;

a boom structure extending horizontally from an inner one of said slides;

a clamp means depending from said boom structure;

a support structure extending from an intermediate section of said standard, which includes, a pair of crossarm sections laterally extending from said standard in substantially parallel relation to said housing, a pair of horizontal arms extending orthogonally from the ends of said crossarms to subtend said clamp, and a pair of legs depending from the ends of the horizontal arms to a position aligned with the underside of said housing;

means for sequentially moving the slides to move said clamp to pick up and move an article between said horizontal arms;

a channel slide mounted in said boom structure for moving a gripped article out between said pair of depending legs; and a drive mechanism mounted in said elongated housing for operating said means for moving said series of slides and for counterbalancing a gripped article when said channel slide is moved to move a gripped article beyond said depending legs.

18. A mobile hoist as defined in claim 17, wherein said means for sequentially moving the slide includes:

a locking member imposed between the standard and a first of said series of slides for holding said slide from movement;

means for urging the locking member into said interposed position; and means actuated by a predetermined movement of another of said slides for acting against said urging means to move the locking member to release said first slide for movement relative to said standard.

* * * * *